US006672929B2

(12) United States Patent
Leleu

(10) Patent No.: US 6,672,929 B2
(45) Date of Patent: Jan. 6, 2004

(54) PUPPET SYSTEM

(76) Inventor: Lisa Leleu, 187 E. Court St., Doylestown, PA (US) 18901

( * ) Notice: Subject to any disclaimer, the term of this patent is extended or adjusted under 35 U.S.C. 154(b) by 41 days.

(21) Appl. No.: 10/135,448

(22) Filed: May 1, 2002

(65) Prior Publication Data

US 2003/0207646 A1 Nov. 6, 2003

(51) Int. Cl.[7] ..... A63H 33/38

(52) U.S. Cl. ..... 446/72; 446/327; 446/147

(58) Field of Search ..... 281/15.1, 51; 446/72, 446/83, 71, 327, 328, 329, 330, 339, 147, 148

(56) References Cited

U.S. PATENT DOCUMENTS

| | | | | |
|---|---|---|---|---|
| 1,028,921 | A | | 6/1912 | Wagner |
| 1,139,643 | A | | 5/1915 | Cross |
| 1,405,134 | A | | 1/1922 | Hoyme |
| 1,490,295 | A | | 4/1924 | Stephens |
| 2,187,407 | A | | 1/1940 | Stone |
| 2,195,127 | A | | 3/1940 | Brucker |
| 2,548,043 | A | | 4/1951 | Mumhauser |
| 2,621,440 | A | | 12/1952 | Stone |
| 2,655,762 | A | | 11/1953 | Burke |
| 2,725,670 | A | | 12/1955 | Hodes |
| 2,740,231 | A | * | 4/1956 | Baller |
| 3,526,990 | A | * | 9/1970 | Edmonds ..... 446/327 |
| 3,698,127 | A | | 10/1972 | Harp |
| 3,742,644 | A | | 7/1973 | Williams |
| 3,778,925 | A | | 12/1973 | Owen |
| 3,789,546 | A | | 2/1974 | Morrison |
| 3,918,180 | A | | 11/1975 | Chamberlin |
| 4,233,772 | A | | 11/1980 | Hamar |
| 4,263,743 | A | | 4/1981 | Hanson |
| 4,280,292 | A | | 7/1981 | Hills |
| 4,508,515 | A | | 4/1985 | Skolnick |
| 4,555,236 | A | | 11/1985 | Peyton |
| 4,608,024 | A | | 8/1986 | Skolnick |
| 5,389,028 | A | | 2/1995 | Cabrera |
| 5,447,461 | A | | 9/1995 | Liao |
| D367,888 | S | | 3/1996 | Lai |
| D386,523 | S | | 11/1997 | Allen |
| 5,746,637 | A | | 5/1998 | Hunt |

* cited by examiner

*Primary Examiner*—Jacob K. Ackun
(74) *Attorney, Agent, or Firm*—Nathaniel Gordon-Clark

(57) ABSTRACT

A puppet system consisting of puppet, or other first body, able to fit within an opening or hole in an second object. The first object has straps that are attached on both ends to the first object. At least one end of the strap is reversibly attachable. The strap is able to fit in second openings in the second objects and then re-attached to the first object securing the first objects to the second object in a loose but secure manner. A preferred embodiment is use of a puppet as the first object and a book cover as the second object so that an operator can use one to both support the book cover and operate the puppet.

36 Claims, 8 Drawing Sheets

PUPPET SYSTEM

FIELD OF INVENTION

The present invention relates to toys. More specifically it relates to puppets. Even more specifically the present invention relates to a puppet that can be separated and reattached to a book cover or other object. In a preferred embodiment, the puppet system fastens a puppet to the cover of a book in a way that allows the operator of the puppet both to move the puppet in a full range of motion and to support the book with one hand inside the puppet.

BACKGROUND OF INVENTION

Several puppet systems are described in the prior art. U.S. Pat. No. 4,508,515 ("the '515 Patent") describes a system by which a puppet is attached to the edge of a book cover by a fastener. While this system allows the puppet operator to place their hand inside the puppet while it is attached, its position makes it difficult for the operator to both move the puppet and support the book. Furthermore, the '515 Patent relies on a simple row of fasteners at the interface of the puppet and the book cover to attach the puppet to the book cover. This arrangement both increases the number of fasteners needed and leaves half the fasteners attached to the book cover. By having some of the fasteners attached to the book cover, the thickness of the book is increased and storage of the book becomes more difficult. Furthermore the '515 Patent requires that pages of the book are permanently attached to the book cover, limiting the '515 Patent puppet system to a single text per puppet.

U.S. Pat. No. 2,187,407 ("The '407 Patent") describes a system by which a small stage can be attached to a person's hand. The stage is attached by a series of rubber bands that wrap around the person's wrist. The disadvantage of this system is that it limits the movement of the finger puppets. Furthermore, with the stage attached to the operators wrist, the operator cannot project the puppet through the opening in the stage, losing any three dimensional motion. Additionally, a puppet that requires a full hand to operate would not be easily used with this stage if the stage used the '407 Patent support system. The hand puppet would have limited movement and would be unable to be projected through the opening in the stage.

SUMMARY OF THE INVENTION

The present invention does not have the disadvantages of the prior art. The present invention also discloses elements and features not found in the prior art.

A puppet system is disclosed in which a first body has a length of material attached to it by the proximal end of the length of material. Alternatively the length of material can be an extension or a branching of the first body. A second body, to which the first body is intended to be fastened, has a second opening that can accommodate the length of material. The length of material is then threaded through the second opening and attached to the first body a second time by a fastener on the distal end of the length of material. Alternatively, the length of material could be attached to the second body with the fastener after the length of material has been threaded through the second opening. The length of material holds the first body to the second body in a loose, but secure manner.

The loose manner allows the motion of the first body relative to the second body. Specifically, the first body is able to move back and forth relative to the second body. This allows the first body to be extended and retracted without being removed from second body. In the embodiment of a puppet as the first body, the puppet could be moved back and forth while loosely attached to a book cover, the second body. This allows multiple positions for packing and display. It also allows the puppet to be moved in a more natural manner while being operated. Thus the puppet operator will have a greater possible range of expression with the puppet. At the same time, the puppet is still loosely fastened to the book cover and the operator can support both the book cover and the puppet at the same time with one hand.

The first body can be fastened to the second body such that the first body extends through a first opening in the second body. Alternatively, the first body could be fastened to the second body such that the two bodies are adjacent to each other. The size of the first opening in the second body is determined by the size of the first body. The first opening must be larger than the first body, but small enough that the first body can be attached to the second body in a secure manner. In the preferred embodiment of a puppet and book cover, the size of the first body is determined by the human body part that must fit into the selected puppet. By way of example, and not meant as a limitation in any way, a hand puppet would result in a hand puppet sized first opening.

The length of material can be flexible or rigid. Only one length of material is required. Additional lengths of material can be added to improve the strength of the attachment. A common arrangement would be to put two lengths of material on opposite sides of the first body. The length of material can be attached to the first body by two permanent attachments, one at either end of the length of material, a permanent attachment in combination with a reversibly attachable fastener, or with two reversibly attachable fasteners. In this application, reversibly attachable means an attachment that can be separated and reattached repeatedly. The reversibly attachable fasteners could be fastened and unfastened by an operator of the puppet. The proximal end of the length of material can be an extension or branching of the first body. In another embodiment, the distal end of the length of material could be unattached and knotted so that it cannot pass through the second opening or hole without being unknotted.

A preferred embodiment contemplated is the fastening of a puppet to a book cover. The puppet would be a hand puppet with an opening in the back that the whole hand can fit into and operate the puppet. On the sides of the body of the puppet, two lengths of material would be attached on opposing sides of the body of the puppet. The length of material would be oriented parallel to the body of the puppet such that one end of the length of material would be near the head of the puppet and the other end of the length of material would be near the back of the puppet and the wrist of the operator. At the least, the end of the length of material that is closest to the wrist of the operator would be reversibly attachable.

The book cover would contain an opening large enough for the puppet to fit within. Two second openings would be near the opening and on opposite sides of the opening. While the preferred embodiment envisions two second openings, the invention is functional with only one or three or more. The lengths of material would be placed though the second openings as the puppet is placed through the opening. Then the ends of the length of material would be secured to the body of the puppet by reversibly attachable fasteners.

The opening in the book cover could be in the front and back or only back cover. The preferred embodiment envisions the opening extending through both covers such that one puppet can fit through both openings. While the openings should be of similar size, they do not need to be of identical size or shape. In the preferred embodiment, the opening is round on the back cover and square and slightly larger in the front cover. The end result is that the puppet extends through both covers so it can be seen when the book is closed, with the hole in the front cover also acting as a frame for the puppet.

The book cover is envisioned as containing a booklet with pictures, text or a combination of the two. This booklet could be permanently attached or reversibly attachably fastened. Thus the same book cover and puppet could be used with more than one booklet by unfastening the booklet and replacing it with a second booklet. Any means of unfastening can be used. One possible means is a "checkbook" system where the back page of the booklet fits within a slot in the back cover of the book cover. In another system, the corners of the back page of the booklet would fit into brackets. In another system, a hook and loop fabric, such as VELCRO, could be used to secure the booklet to the book cover.

In a more preferred embodiment, the booklet would be placed underneath the opening so that the puppet is above the booklet. In this preferred embodiment, any drawings in the booklet would be drawn so it would seem as if the puppet is an extension of the drawing in the booklet. Thus the puppet would seem to be a three-dimensional portion of the drawing. This illusion would further assist the operator in animating the story while operating the puppet. The placement of the booklet must be close enough to the opening so that the illusion is believable. This may require the booklet to be nearly flush with the opening. Alternatively, the booklet could be a distance from the opening and additional drawings on the book cover could be used to assist in creating the illusion. The book cover itself could also contain text and drawings to affect the same illusion without the booklet.

The present puppet system would allow the operator of the puppet to both operate the puppet and support the book with the same hand. This allows the operators other hand to turn pages, make drawings, sell merchandise or operate a second puppet.

Furthermore, this puppet system allows the use of puppets that require an entire hand to operate.

Furthermore, in the preferred embodiment, all the fasteners are contained on the puppet. This allows the book to have slim profile that improves storage and packagability by allowing the removal of the puppet.

Additionally, the operator could change puppets during a drama, or remove the puppet to give to another person, or remove the puppet for more efficient storage of both the book and the puppet. The '515 Patent required the book to have fasteners on it which makes the book thicker and consumes more storage space, as well as increasing the difficulty with packaging the book.

These and other features and objects of the invention will be more fully understood from the following detailed description of the preferred embodiments which should be read in light of the accompanying drawings.

BRIEF DESCRIPTION OF THE DRAWINGS

The accompanying drawings, which are incorporated in and form part of the specification, illustrate the embodiments of the present invention and, together with the description, serve to explain the principles of the invention.

DETAILED DESCRIPTION OF THE PREFERRED EMBODIMENT

Figure 1:
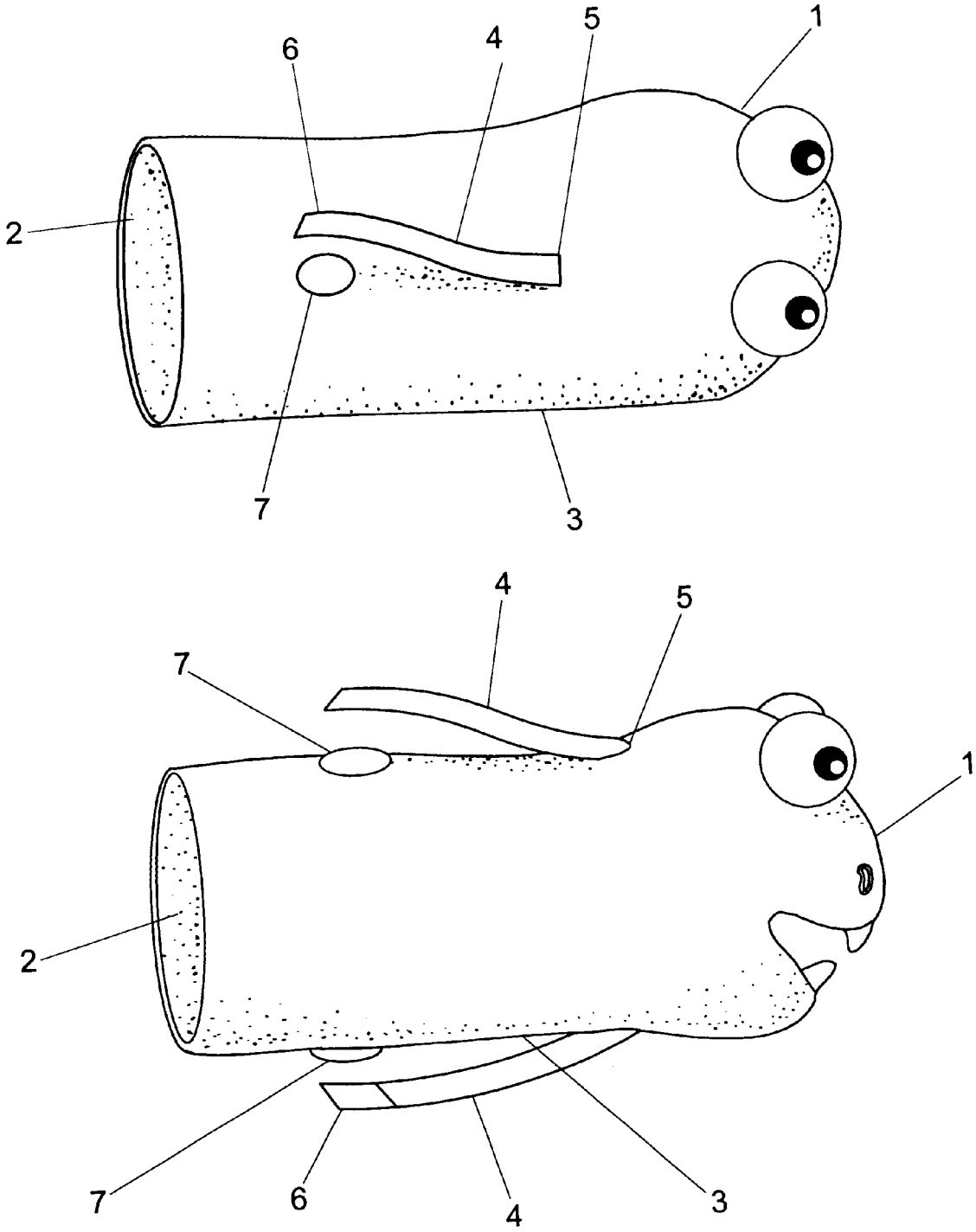
FIG. 1 illustrates an embodiment of the puppet system as a hand puppet.

In describing a preferred embodiment of the invention illustrated in the drawings, specific terminology will be used for the sake of clarity. However, the invention is not intended to be limited to the specific term. The specific terms used include all technical equivalents that operate in a similar manner to accomplish a similar purpose.

With reference to the drawings, in general, and FIGS. 1 through 8 in particular, the apparatus of the present invention is disclosed.

FIG. 1 illustrates a puppet 1 with the puppet system. The puppet has a body 3 that contains an opening 2 for a hand. A length of material 4 is attached to the body 3 at point 5 by the proximal end of the length of material 4. Alternatively, the length of material 4 could be an extension of the body 3 or a branch of body 3, such that this extension or branch is placed at point 5. A reversibly attachable fastener 6 is attached to the distal end of the length of material 4. A corresponding reversibly attachable fastener 7 is attached to the body 3 in such a position that reversibly attachable fastener 6 can be fastened and unfastened to corresponding reversibly attachable fastener 7.

Figure 2:
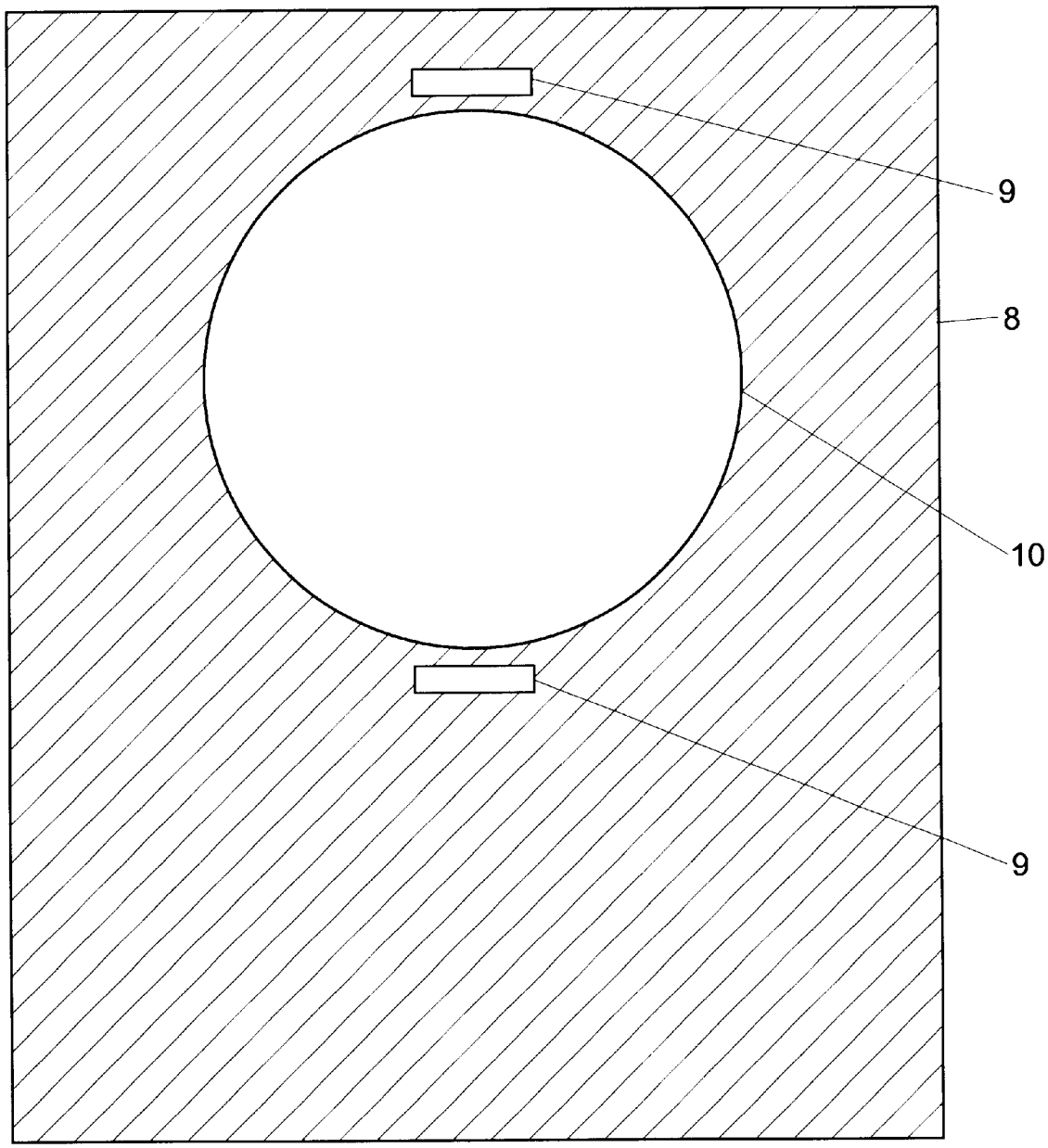
FIG. 2 illustrates an embodiment of the puppet system with book cover that is able to receive the puppet system.

FIG. 2 illustrates a sign, book cover or stage back 8 that can receive the puppet 1 with the puppet system. The book cover 8 has a first opening 10 that can receive the body 3 of puppet 1. Adjacent to the first opening 10 are two second openings 9 that can receive length of material 4. The book cover 8 can also be any object that has both a first opening 10 and adjacent second openings 9.

Figure 3:
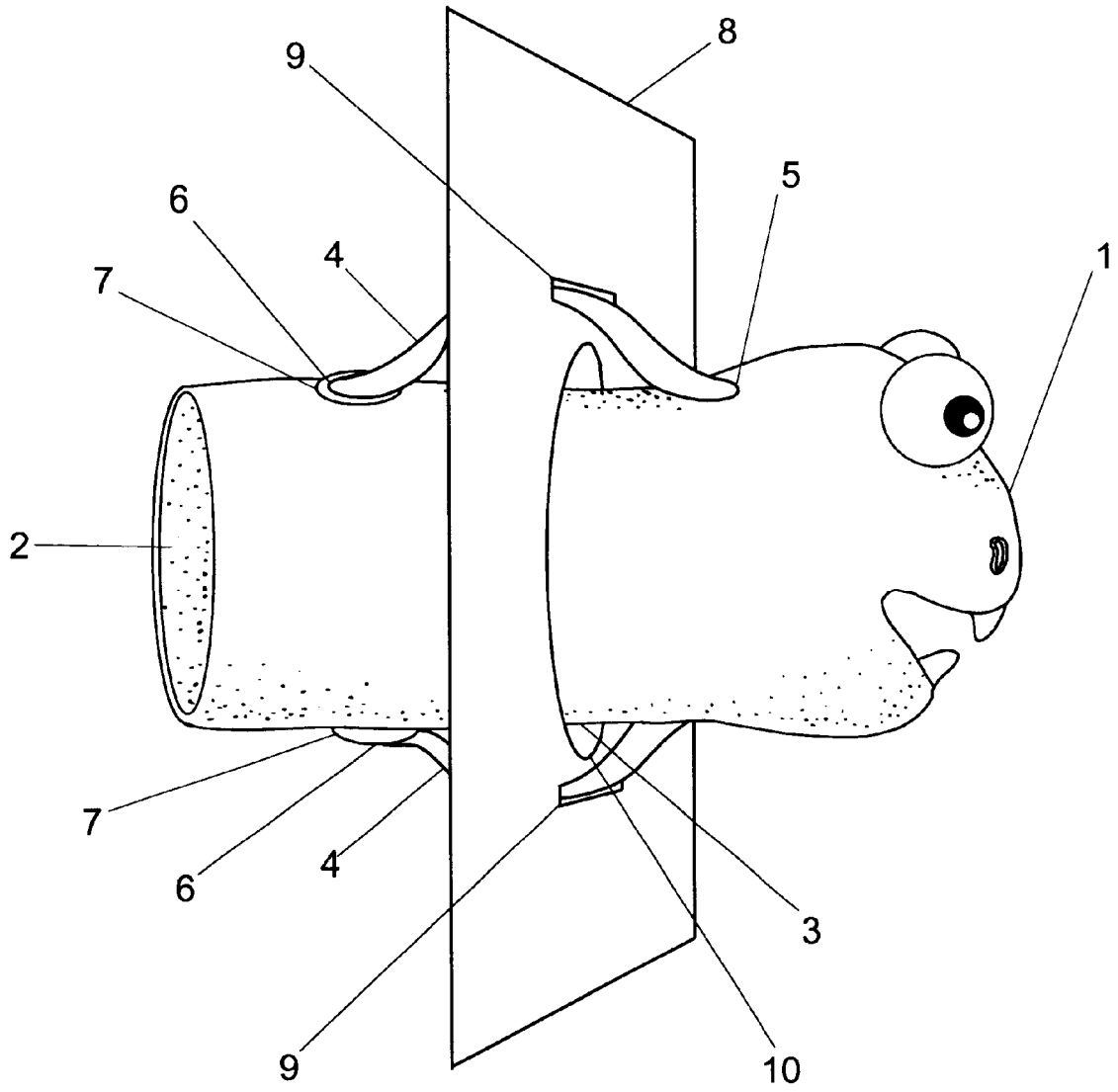
FIG. 3 illustrates an embodiment of the puppet system with the puppet from FIG. 1 attached to the book cover from FIG. 2.

FIG. 3 illustrates puppet 1 being detachably attached to book cover 8 by the puppet system. The body 3 of puppet 1 is within the first opening 10 of book cover 8. Point 5 and reversibly attachable fastener 6 are on opposite sides of book cover 8. Length of material 4 in placed within second opening 9. Reversibly attachable fastener 6 is then fastened to corresponding reversibly attachable fastener 7 and the puppet 1 is loosely but securely attached to book cover 8. Once attached, an operator can operate puppet 1 by placing a hand in opening 2 and both supporting book cover 8 and operating puppet 1.

Figure 4:
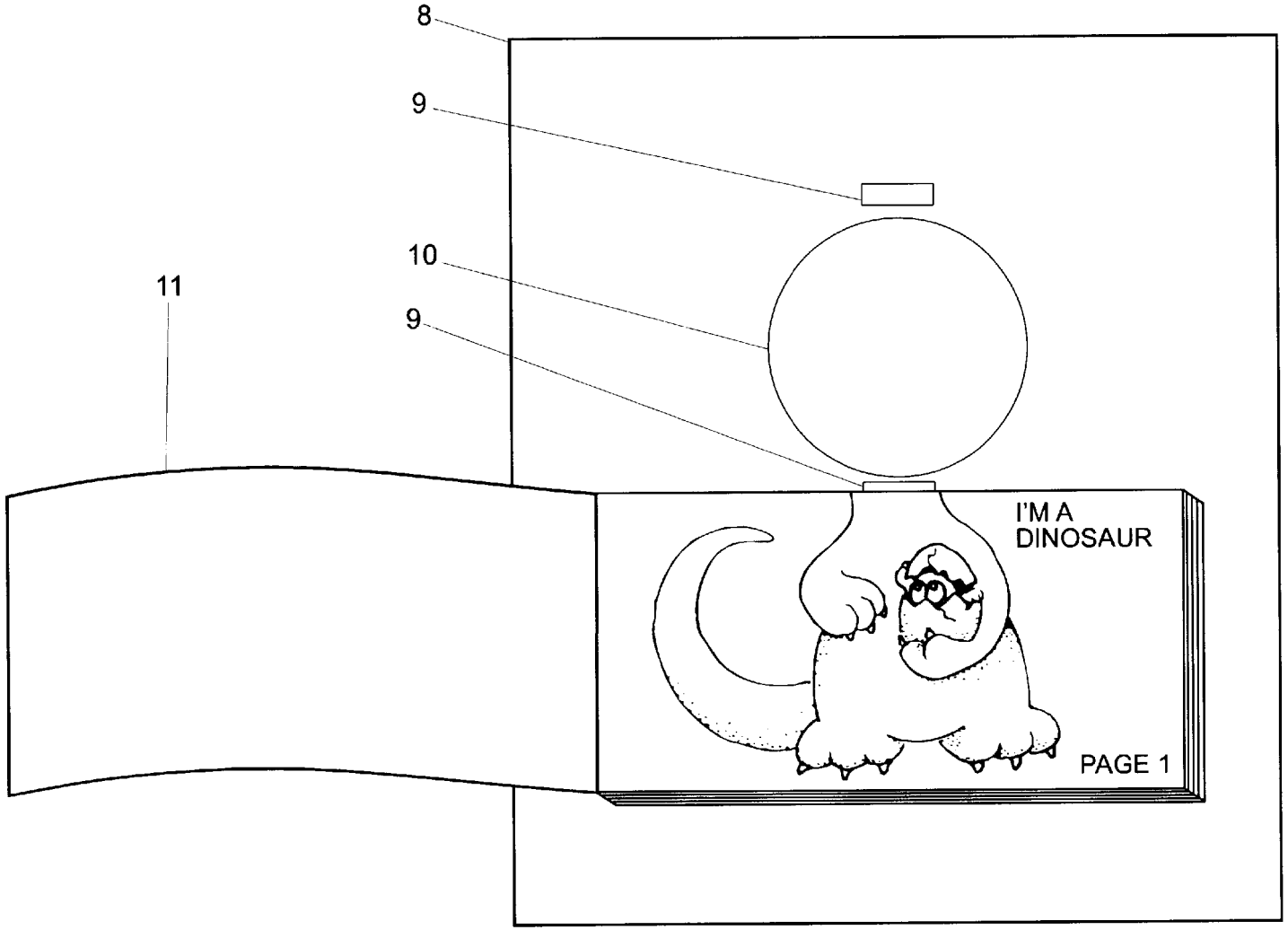
FIG. 4 illustrates an embodiment of the puppet system with a booklet attached to the book cover from FIG. 2.

FIG. 4 illustrates the book cover 8 from FIG. 2 with a booklet 11 fastened to book cover 8. The booklet 11 is placed below the first opening 10, but closely proximal to first opening 10. The booklet 11 is attached by any means that is convenient. The booklet 11 is preferably placed such that it seems that the puppet 1 is an extension of the drawings in the booklet 11. Thus allowing an operator to animate the puppet 1 while telling the story in the booklet 11.

Figure 5:
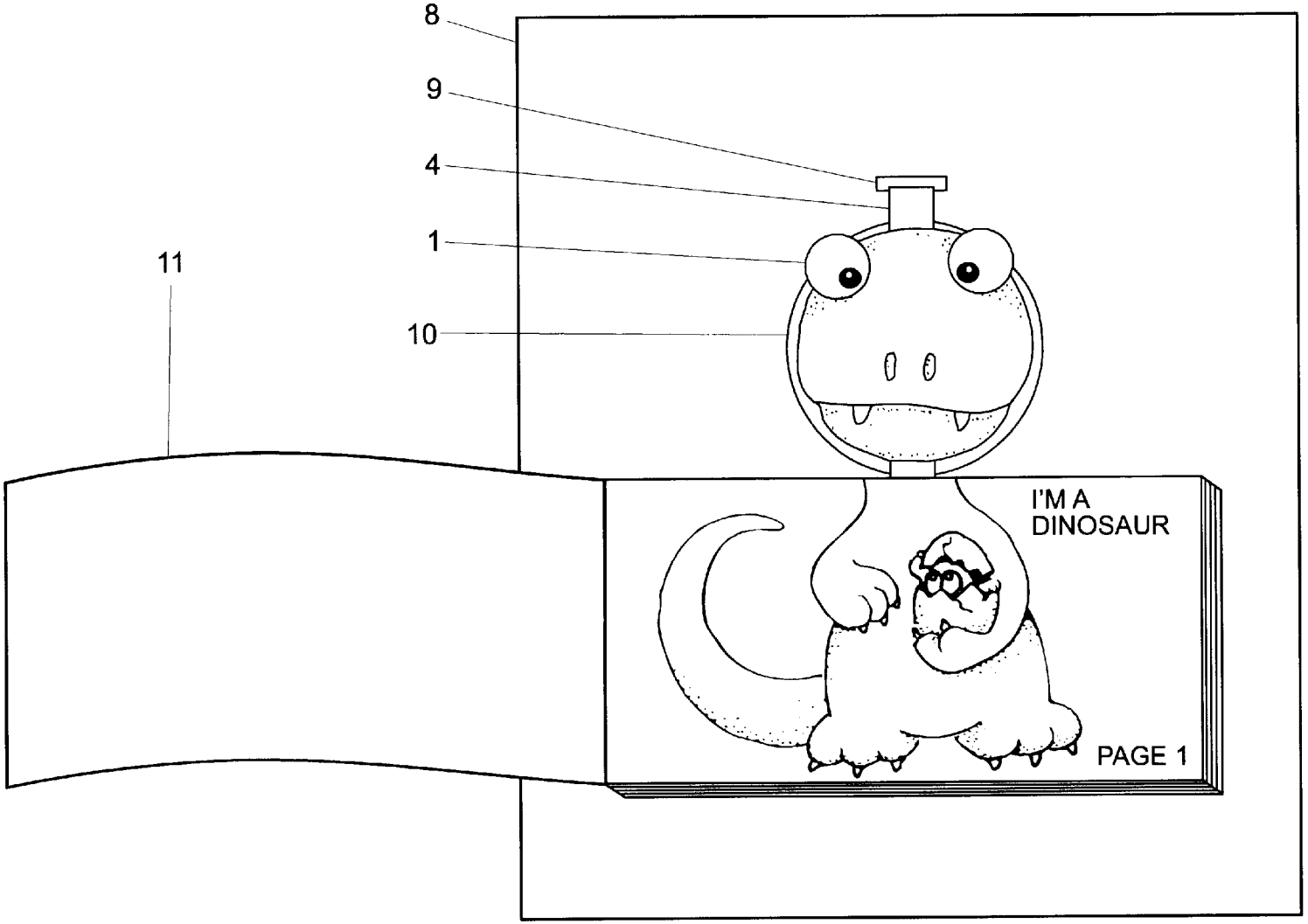
FIG. 5 illustrates an embodiment of the puppet system with the puppet from FIG. 1 attached to the book cover and booklet combination from FIG. 4.

FIG. 5 illustrates the book cover 8 and booklet 11 combination from FIG. 4 with the puppet 1 from FIG. 3 placed through first opening 10. The length of material 4 is placed through second opening 9 and the puppet 1 is loosely attached to the book cover 8.

Figure 6:
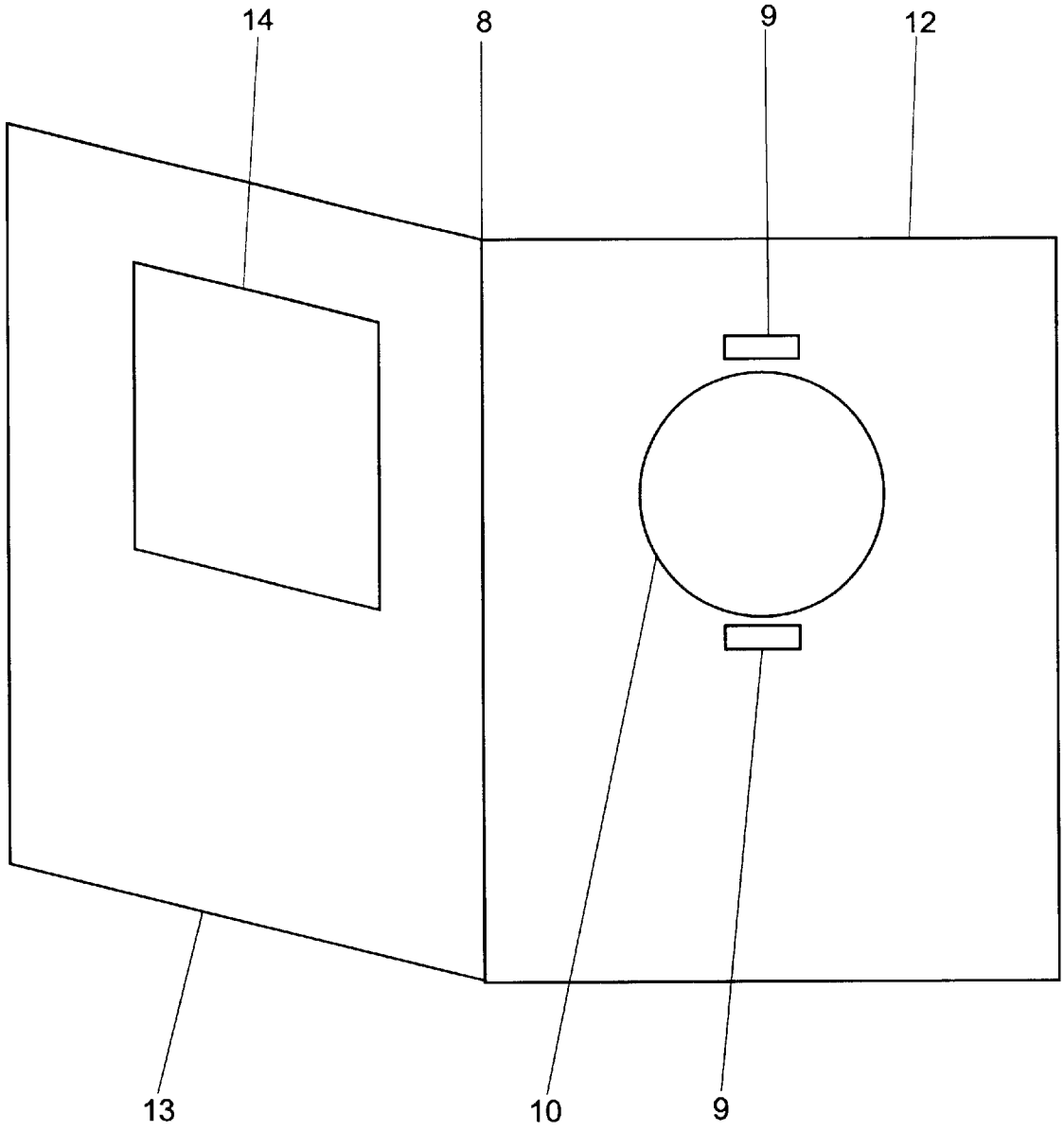
FIG. 6 illustrates an embodiment of the puppet system with both the front and back cover of the book cover shown in an open position.

FIG. 6 illustrates the book cover 8 with both the front cover 13 and back cover 12 shown in an open position. In the front cover 13 is a third opening 14. The first opening 10 and second opening 9 are also shown.

Figure 7:
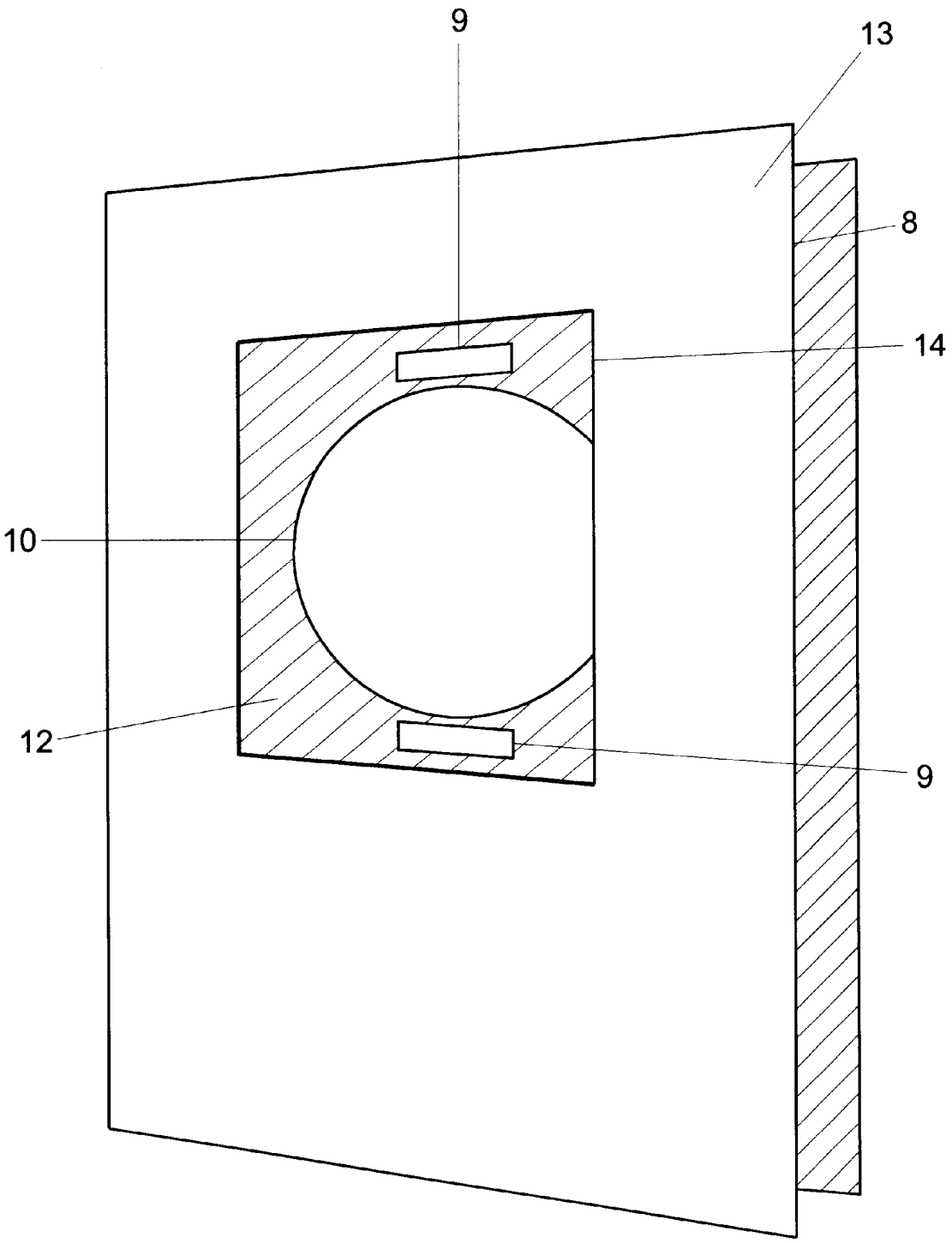
FIG. 7 illustrates an embodiment of the puppet system with the front and back covers of the book cover with the book cover in a closed position.

FIG. 7 illustrates the book cover 8 with both front book cover 13 and back book cover 12 shown in a closed position. The front cover has the third opening 14 which lines up with the first opening 10. Second opening 9 can also been seen.

Figure 8:
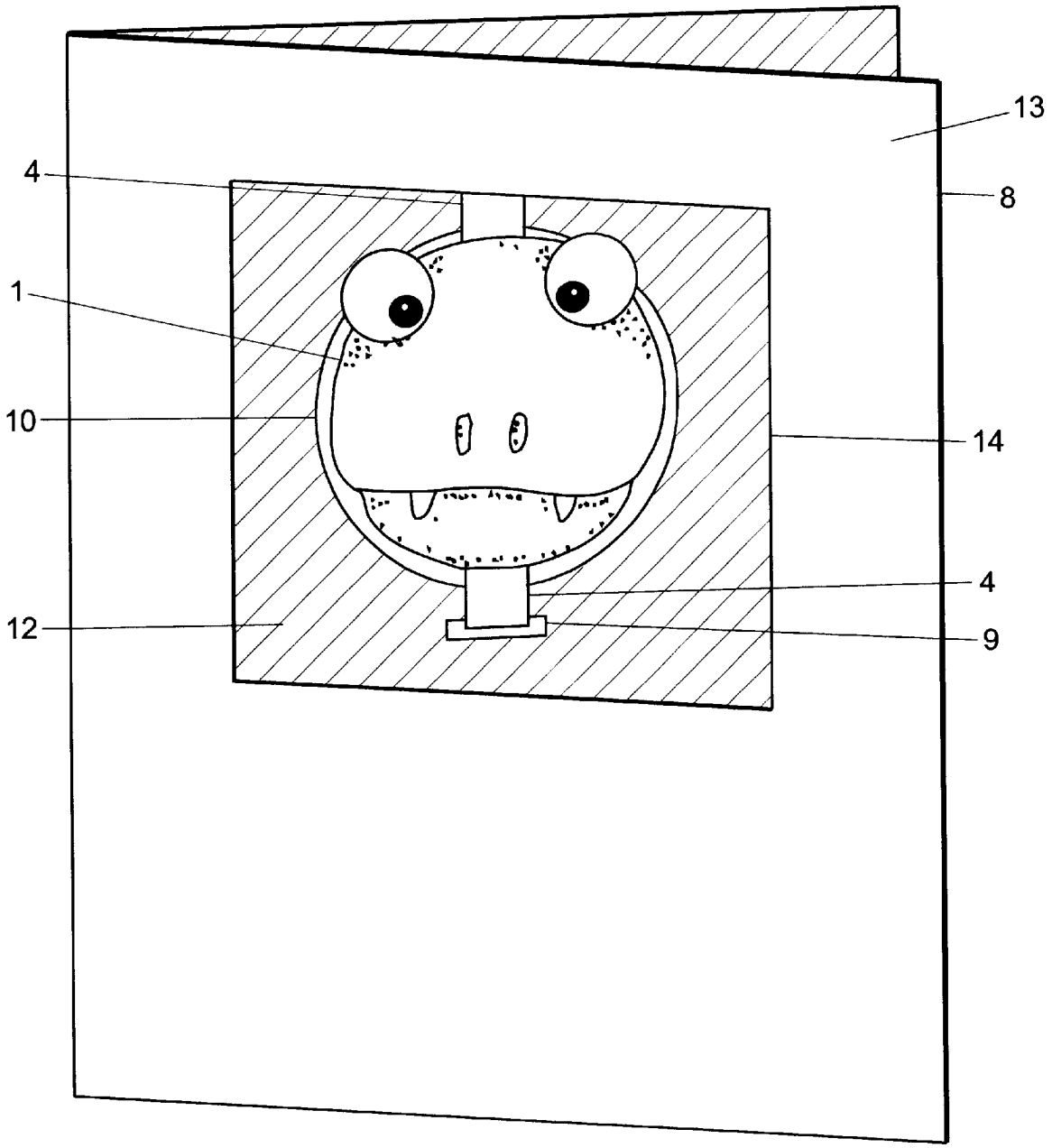
FIG. 8 illustrates an embodiment of the puppet system with the front and back book covers from FIGS. 6 and 7 with the puppet from FIG. 1 attached to the book cover.

FIG. 8 illustrates the book cover 8 with the front book cover 13 and the back book cover 12 in a closed position. A third opening 14 is lined up with first opening 10. The puppet 1 can be seen in first opening 10, with the length of material 4 placed within the second opening 9, loosely securing the puppet 1 to the book cover 8. The third opening 14 is positioned such that the puppet 1 can be see when the book cover 8 is closed, or projects through the front book cover 13, depending on the relative size of the puppet 1 and the thickness of the book created by book cover 8 and the booklet 11.

Any object that is able to fit within first opening 10 can replace puppet 1. Other possible objects that could be used would be dolls, action figures, toys, cloths, gloves, socks, shoes, boots, mittens, gators, pants, sleeves, holsters or harnesses. The only requirement is that any object used as a replacement for puppet 1 must have the puppet system attached to that object in the correct position.

The puppet 1, or replacement, can be made of any material, rigid or flexible. Puppet 1 is limited only to materials that can fit through first opening 10. Conversely first opening 10 must be able to accommodate puppet 1. The minimum size of first opening 10 is thus limited by the size of puppet 1. The maximum size of first opening 10 is the size at which puppet 1 cannot be securely attached to book cover 8. The size of puppet 1 is determined by the size of the body part that must fit into puppet 1 to operate puppet 1. In a preferred embodiment, puppet 1 is a hand puppet. Thus the size of puppet 1 is determined by the size of a hand. First opening 10 must be larger than a hand with the hand puppet 1 on it, but small enough that hand puppet 1 can be secured to book cover 8. In an alternative embodiment, puppet 1 could be a two-finger puppet. Thus first opening 10 would only need to be large enough to accommodate two fingers.

The book cover 8 could have a first opening 10 that extends through both the front book cover 13 and back book cover 12, or only back book cover 12 of the book cover 8. In the preferred embodiment, the first opening 10 would extent through both covers of the book cover 8. This allows the puppet 1 to extent through both covers of the book cover 8. The openings in the two covers of book cover 8 that form the first opening 10 and third opening 14 do not need to be of the same size or shape, but must be of similar size and shape. The whole of the first opening 10 must be able to accommodate the puppet 1. In the preferred embodiment, first opening 10 is a round hole in the back cover of book cover 8 and a square hole in the front of book cover 8. This creates a frame for the puppet 1 once placed in first opening. This frame can be used to display the puppet for sale by creating an attractive and eye-catching form of packaging.

In a preferred embodiment, the book cover 8 has a front cover 13 and a back cover 12. Within front cover 13 is third opening 14. First opening 10 would be in the back cover 12. The third opening 14 is position such that it is substantially aligned with first opening 10. Third opening 14 and first opening 10 are positioned such that the puppet 1 can fit through both of them at the same time. Thus the puppet 1 can be seen when the book cover 8 is closed. This arrangement assists in both packaging and display of the puppet system. The puppet system can be packaged as a single unit, with the book cover 8 closed to protect its contents. At the same time, the puppet 1 can be seen through the third opening 14, acting as a display.

Third opening 14 can act as a frame or stage for the puppet 1. The shape of third opening 14 can be any shape that allows puppet 1 to fit through. By way of example and not meant to limit the invention in any way, the shape of the third opening 14 can be round, square or rectangular. The size of third opening 14 can be large enough to allow puppet 1 to pass through. Third opening 14 can be no larger that the width and length of book cover 8.

The booklet 11 is attached to the book cover 8. This attachment can be permanent or reversibly attachable. In the preferred embodiment, booklet 11 is reversibly attachable. Thus an operator of the puppet system can replace one booklet 11 with another booklet 11. This allows the operator to use the same puppet system with multiple booklets 11 and thus allows one puppet system to be used in multiple stories, drama or sales pitches. In the preferred embodiment, the booklet 11 is fastened below the first opening 10 on the book cover 8 such that the booklet 11 is very close to the bottom edge of first opening 10. In the preferred embodiment, the booklet 11 is fastened to the inside of the back cover of the book cover 8. The booklet could be placed in other positions as well. The goal of the preferred embodiment is to create the illusion that the drawings in the booklet 11 are an extension of the puppet 1 and the puppet 1 is an extension of the drawings in booklet 11.

Booklet 11 can contain any combination of text, drawings and designs. Preferably the text or drawings in booklet 11 are related and interrelated to puppet 1. Alternatively, the text or drawings could be placed directly on book cover 8. By way of example and not meant to be a limitation in any way, a dinosaur puppet system, with a dinosaur puppet as puppet 1, could be used with a booklet 11 that contained text about dinosaurs and had a picture of a dinosaur on each page drawn so that the puppet 1 is in the position of the dinosaurs head. An operator could then move the puppet 1 and tell the story as if the dinosaur was telling the story, thus animating the text. Booklet 11 could then be replaced with other stories about the same dinosaur puppet, allowing the operator to animate a second story about that dinosaur. For a humorous effect, an operator could replace the dinosaur booklet 11 with a booklet 11 meant for a cat puppet system. Thus the story of the cat, in the cat booklet 11, would be told by a dinosaur head puppet 1, with the intent of entertaining young children.

Booklet 11 is placed between front cover 13 and back cover 12 in the preferred embodiment, with the booklet 11 fastened to the back cover 12. In other embodiments, booklet 11 could be placed on front cover 13 so that booklet 11 lines up with third opening 14. In this embodiment, the illusion that the drawings in booklet 11 are continuous with puppet 1 would be on front cover 13.

The length of material 4 may be made of any material, rigid or flexible. It may include multiple segments. It may also include hinges. It may be made of multiple materials that each has different qualities. In any given use, length of material 4 must be able to fit through second opening 9. Conversely second opening 9 must be able to accommodate length of material 4. The size of second opening 9 is determined by the size and width of length of material 4. Second opening 9 must be wide enough to allow length of material 4 to pass through, but second opening 9 must be small enough to allow length of material 4 to securely attach puppet 1 to book cover 8. Possible flexible materials that length of material 4 could be made from are cloth, rope, string, wire, a hook and loop fabric, such as VELCRO, and plastic fabric. Possible rigid materials that length of material 4 could be made from are wood, metal or plastic.

In a preferred embodiment, length of material 4 can be long enough to allow motion by puppet 1. The goal is to allow puppet 1 to have a natural range of motion and to allow a puppet operator to have a greater range of expression with puppet 1. Length of material 4 can be long enough to allow back and forth motion by puppet 1 when puppet 1 is loosely fastened to book cover 8. This back and forth motion allows the operator to show a greater range of emotions in puppet 1. This range of motion also allows puppet 1 to be placed in the optimal position for storage and display.

Length of material 4 is attached to the body 3 at point 5. This attachment can be permanent or reversibly attachable. The attachment point 5 can be made by a peg and hole system, a hinge, a hook and loop system, a hook and loop fabric like VELCRO, stitching, welding, glue, or any other means of attachment permanent or reversibly attachable. The length of material 4 could also be continuous and integral with body 3 such that length of material branches off from body 3 at point 5.

Reversibly attachable fastener 6 is preferably attached to the opposite, or distal, end of length of material 4 from point 5, at the proximal end of length of material 4. Reversibly attachable fastener 6 can also be reversibly attachable from length of material 4. Reversibly attachable fastener 6 can be made from any reversibly attachable fastener such as a hook and loop system, a snap, a hook and loop fabric like VELCRO, a button, or any other reversibly attachable fastener. Corresponding reversibly attachable fastener 7 preferably is placed on body 3 such that reversibly attachable fastener 6 can attach to corresponding reversibly attachable fastener 7. To explain by way of example and not to limit, if reversibly attachable fastener 6 was a buttonhole, corresponding reversibly attachable fastener 7 would be the button that could fit in that buttonhole. In an alternative reversibly attachable fastener, length of material 4 could be made of a material that is flexible, like string, or made of multiple materials with a flexible material on the end with reversibly attachable fastener 6 such that the string could be knotted and prevent length of material from slipping out of second opening 9. In this string and knot puppet system, corresponding fastener 7 could be removed. Another variation of the string and knot system would be a third opening in place of corresponding fastener 7 and the string on length of material 4 would be threaded through the second opening at corresponding fastener 7 and then knotted so that it could slide back through.

Another possible attachment system embodiment would have reversibly attachable fastener 6 loop back to length of material 4 or point 5 to form a loop to secure puppet 1 to book cover 8. Length of material 4 would be threaded through second opening 9 and then threaded through first opening 10. Reversibly attachable fastener 6 would then attach to length of material 4 or point 5, forming a loop. Alternatively, corresponding fastener 7 would be at point 5, or along length of material 4, and reversibly attachable fastener 6 would attach to it after the above loop had been formed by length of material 4.

Yet another possible attachment system embodiment would place corresponding fastener 7 on book cover 10. Length of material 4 would be threaded through second opening 9 and then reversibly attachable fastener 6 would be attached to corresponding fastener 7 on book cover 8.

Second opening 9 can be any opening that can accommodate length of material 4. Second opening 9 could be a hole, slot, space or other opening. The puppet system requires that at least one second opening 9 and one length of material 4 at point 5 and reversibly attachable fastener 6 and exist for the system to work. More than one second opening 9 and more than one length of material 4 can be used so long as each second opening 9 is positioned to receive a length of material 4. More than one length of material 4 can fit through one second opening 9. The second openings 9 and lengths of material 4 can be placed in any pattern that also fit the above requirements. In FIG. 2 two second openings 9 are shown in an opposing position and in FIG. 1 two lengths of material 4 are shown in an opposing position, but this is meant as an example and not as a limitation.

The inventor believes that a minimum of two second openings 9 and two lengths of material 4 placed in an opposing arrangement, such a shown in FIGS. 1 and 2, is the most secure puppet system and best mode, but other arrangements are also effective. Although this invention has been illustrated by reference to specific embodiments, it will be apparent to those skilled in the art that various changes and modifications may be made which clearly fall within the scope of the invention. The invention is intended to be protected broadly within the spirit and scope of the appended claims.

What is claimed is:

1. A puppet system comprising:

a first body that is hollow with a closed end and an open end;

a length of material with a proximal end and a distal end that is continuous with the first body from the proximal end;

a first opening in a second body through which the first body can be placed;

a second opening next to the first opening in the second body through which the length of material can be placed; and a fastener attached top the distal end of the length of material;

wherein the first body is placed within the first opening and the length of material is placed through the second opening and secured by the fastener such that the first body can move continuously forward and backwards between a non-extended position in which the closed end of the first body is positioned next to the first opening and an extended position in which the closed end of the first body is extended out from the first opening.

2. The puppet system in claim 1 wherein the fastener attached the first body to the second body; and wherein the fastener is releasable such that the first body can be reversibly attached to the second body.

3. The puppet system in claim 1 wherein the second body is a book cover.

4. The puppet system in claim 1 further comprising the fastener selected from a group consisting of a loop and hook system, a loop and hook fabric fastener, a snap, a button, and a knot.

5. The puppet system in claim 1 further comprising a sign as the second body.

6. The puppet system in claim 1 further comprising the second opening selected from a group consisting of a slot, slit and a hole.

7. The puppet system in claim 1 further comprising a book, with a front cover and a back cover, as the second body.

8. The puppet system in claim 7 further comprising a hole in both covers of the book as the first opening such that the first body can pass through both covers of the book.

9. The puppet system in claim 7 further comprising a booklet attached to the book.

10. The puppet system in claim 9 further comprising a drawing in the booklet that seems integral to and continuous with the first body.

11. The puppet system in claim 7 further comprising a booklet that is reversibly attachable to the book.

12. The puppet system in claim 1 further comprising the length of material made of cloth.

13. The puppet system in claim 1 further comprising the length of material is attached to the first body at the proximal end of the length of material.

14. The puppet system in claim 1 further comprising threading the length of material through the second opening and then threading the length of material through the first opening and fastening the distal end of the length of material to a point along the length of material such that the length of material forms a loop.

15. The puppet system in claim 1 further comprising a drawing on the second body such that the drawing seems integrated into and continuous with the first body.

16. The puppet system in claim 1 further comprising a puppet as the first body.

17. The puppet system in claim 1 wherein the fastener attached the first body to the second body; and wherein the fastener is permanent such that the first body cannot be detached from the second body.

18. The puppet system in claim 1 wherein the first opening overlaps an edge of the second body.

19. The puppet system in claim 1 wherein the first body is adjacent to the second body.

20. A puppet system comprising:

a puppet;

a book cover with a first opening through which the puppet can enter;

a length of material with a proximal end and a distal end that is continuous with the puppet by the proximal end;

a fastener attached to the distal end of the length of material; and a second opening next to the first opening on the book through which the length of material can fit;

wherein when the puppet is placed through the first opening and the length of material is placed through the second opening, the fastener holds the puppet and the book together while allowing the puppet to move through the first opening in a direction perpendicular to the first opening.

21. The puppet system in claim 20 further comprising the length of material that is attached to the puppet by the proximal end of the length of material.

22. The puppet system in claim 20 further comprising a loop and hook fabric fastener as the fastener.

23. The puppet system in claim 20 further comprising a hook as the fastener.

24. The puppet system in claim 20 further comprising a snap as the fastener.

25. The puppet system in claim 20 further comprising a knot as the fastener.

26. The puppet system in claim 20 further comprising a front and back cover in the book wherein the front cover contains a third opening that is substantially in alignment with the third opening in the back cover so that s puppet placed through the second opening could also be placed through the third opening when the book is closed.

27. The puppet system in claim 26 further comprising a booklet that is attached to the book.

28. The puppet system in claim 26 further comprising a drawing in the booklet that seems to be continuous with the puppet.

29. The puppet system in claim 26 further comprising a booklet that is reversibly attachable to the book.

30. The puppet system in claim 20 further comprising a drawing in the booklet that seems to be continuous with the puppet.

31. The puppet in claim 20 wherein the fastener attaches the puppet to book cover; and wherein the fastener is releasable such that the puppet can be detached from the book cover.

32. The puppet system in claim 20 wherein the fastener attaches the puppet to the book cover; and wherein the fastener is permanent such that the puppet cannot be detached from the book cover.

33. The puppet system in claim 20 wherein the first opening overlaps an edge of the second body.

34. The puppet system in claim 20 wherein the first body is adjacent to the second body.

35. A puppet system comprising:

a first cover;

a length of material, with a proximal end and a distal end, releaseably attachable by the proximal end to the first cover;

a puppet releaseably attachable to the distal end of the length of material;

a story book, containing a plurality of drawings, attachable to the first cover;

wherein the puppet is releasably attachable to the first cover so as to be placed relative to the story book such that the puppet and the drawings on the story book form an integral image.

36. The puppet system in claim 1 further comprising a story book that is reversibly attachable to the first cover.

* * * * *